US006991305B2

(12) United States Patent
Gallea

(10) Patent No.: US 6,991,305 B2
(45) Date of Patent: Jan. 31, 2006

(54) CORNER STORAGE CABINET

(75) Inventor: Mark Gallea, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 0 days.

(21) Appl. No.: 10/434,261

(22) Filed: May 8, 2003

(65) Prior Publication Data

US 2004/0061419 A1 Apr. 1, 2004

Related U.S. Application Data

(60) Provisional application No. 60/415,073, filed on Oct. 1, 2002.

(51) Int. Cl.
*A47B 81/00* (2006.01)

(52) U.S. Cl. ..... 312/238

(58) Field of Classification Search ..... 312/238, 312/257.1, 305, 351, 125, 135, 277, 265.5, 312/195, 108; 108/183, 17, 66; 29/428
See application file for complete search history.

(56) References Cited

U.S. PATENT DOCUMENTS

| | | | | |
|---|---|---|---|---|
| 3,538,863 | A * | 11/1970 | Howard et al. | 108/94 |
| 3,982,800 | A * | 9/1976 | Gorton et al. | 312/305 |
| 4,433,885 | A | 2/1984 | Baker | |
| 4,440,459 | A | 4/1984 | Hallgren | |
| 4,486,106 | A | 12/1984 | Benting | |
| 4,572,595 | A | 2/1986 | Craig | |
| 4,688,686 | A | 8/1987 | Mitts et al. | |
| 5,279,429 | A | 1/1994 | Sagel | |
| 5,524,775 | A | 6/1996 | Kaine | |
| 6,017,108 | A | 1/2000 | Domenig | |
| 6,523,917 | B2 * | 2/2003 | Twellmann | 312/238 |

FOREIGN PATENT DOCUMENTS

WO WO89/10081 * 11/1989

* cited by examiner

*Primary Examiner*—Milton Nelson, Jr.
(74) *Attorney, Agent, or Firm*—Patterson, Thuente, Skaar & Christensen, P.A.

(57) ABSTRACT

The storage cabinet including a housing structure, a center column assembly having a center column in which the center column assembly is mounted in the housing structure, and a reconfigurable shelf assembly having at least two partial shelves. The partial shelves may be mounted to the center column to form a coplanar shelf surface.

23 Claims, 6 Drawing Sheets

CORNER STORAGE CABINET

RELATED APPLICATION

The present application claims the benefit of U.S. Provisional Application No. 60/415,073 filed Oct. 1, 2002, which is incorporated herein in its entirety by reference.

FIELD OF THE INVENTION

The present invention relates generally to a piece of furniture for storage. More particularly, the present invention relates to a piece of furniture for storing equipment, specifically musical equipment.

BACKGROUND OF THE INVENTION

In many fields, it is necessary to store objects during periods in which it is not desired to use the objects. Various types of shelving systems have been developed to address needs in this area.

Certain objects, such as musical instruments, have a high value and/or are easily damaged if used in an inappropriate manner. In these situations, it is desirable to place the objects in a storage locker that enables the objects to be securely stored when not in use. One such system is marketed by the assignee of the present application.

When storing objects in locations where the storage cabinets are located on adjoining walls, there is typically a region in front of one of the storage systems that cannot be used because of potential interference with other portions of the storage system. Especially in smaller rooms, these unusable regions dramatically lower the potential storage efficiency.

Examples of rotary shelf systems are disclosed in the following patents: Domenig, U.S. Pat. No. 6,017,108; Baker, U.S. Pat. Nos. 4,443,885; 4,688,686; and Benting, U.S. Pat. No. 4,486,106.

SUMMARY OF THE INVENTION

The present invention is directed to a storage cabinet that is particularly suited for use in a corner. The corner storage cabinet generally includes a center column assembly that is mounted in an enclosure. The center column assembly is adapted to receive one or more different storage mechanisms that permit the corner storage cabinet to be selectively configured to store objects having various dimensions.

Another embodiment of the present invention is directed to a corner storage cabinet that includes an enclosure and at least one shelf or hanger mounted therein.

DETAILED DESCRIPTION OF THE DRAWINGS

A corner storage cabinet according to the present invention is shown generally at 10 in the figures. The corner storage cabinet 10 consists of a housing structure 12 within which is a support assembly 14 for use in storing items having various dimensions.

The corner storage cabinet 10 of the present invention enhances the efficiency for using storage space in a particular room by utilizing corner space that is typically not used with conventional designs. The support assembly 14 is rotatably mounted in the corner storage cabinet 10 to enhance the ability to access items stored therein. Additionally, the corner storage cabinet 10 is reconfigurable to change the storage configuration depending upon needs during different times of the year.

Figure 1:
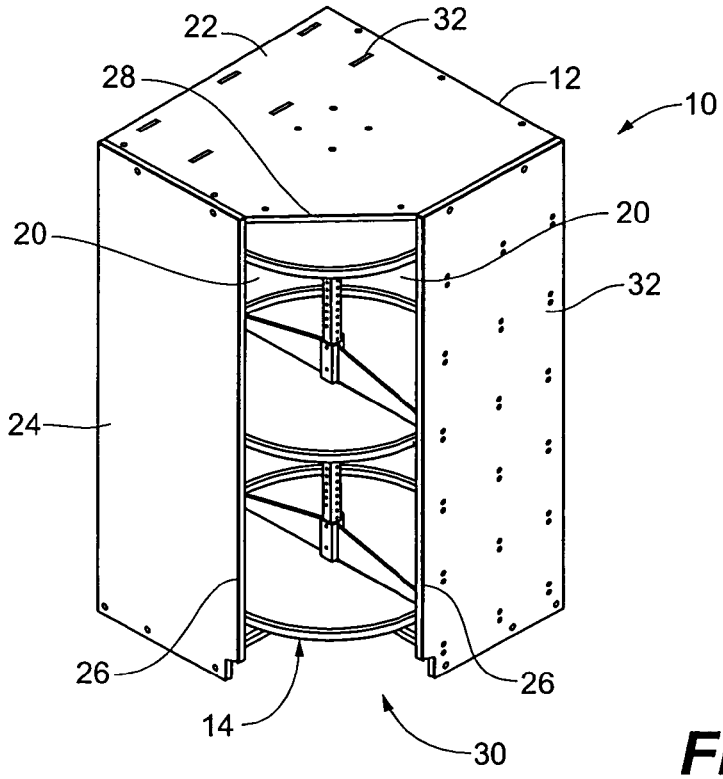
FIG. 1 is a perspective view of a corner storage cabinet according to an embodiment of the present invention

Referring to FIG. 1, the housing structure 12 consists of two adjacent back panels 20, a top panel 22, and two side panels 24. Depending on a location where it is desired to use the corner storage cabinet 10, the housing structure 12 may also include a bottom panel (not shown).

The back panels 20, the top panel 22, and the two side panels 24 are preferably fabricated from melamine, plastic panels, metallic panels, wood, or laminated wood. The corner storage cabinet 10 has a height of at least four feet and preferably about seven feet. The corner storage cabinet 10 has a width and a length of at least two feet and preferably about four feet.

A front opening 30 for access to the cabinet contents is defined by proximal edges 26 of the side panels 24 and a front edge 28 of the top panel 22. As is discussed in more detail below, a front door (not shown) may be provided to close off the front opening 30 and thereby restrict access to items stored in the corner storage cabinet 10.

The side panels 24 and the top panel 22 preferably include a plurality of vent holes 32 to allow for air circulation and moisture dissipation within the housing structure 12. The vent holes 32 thereby reduce the potential that items stored in the corner storage cabinet 10 will develop a musty smell or otherwise become undesirable to use. The size and spacing of the vent holes 32 is selected based upon the amount of air circulation and moisture dissipation that is desired.

Figure 2:
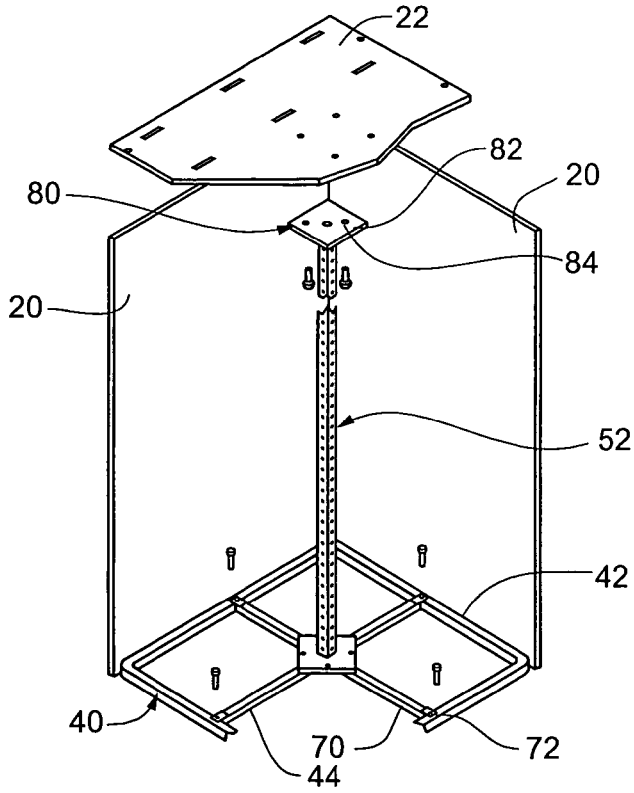
FIG. 2 is a perspective view of a bottom frame assembly of the corner storage cabinet.
Figure 3:
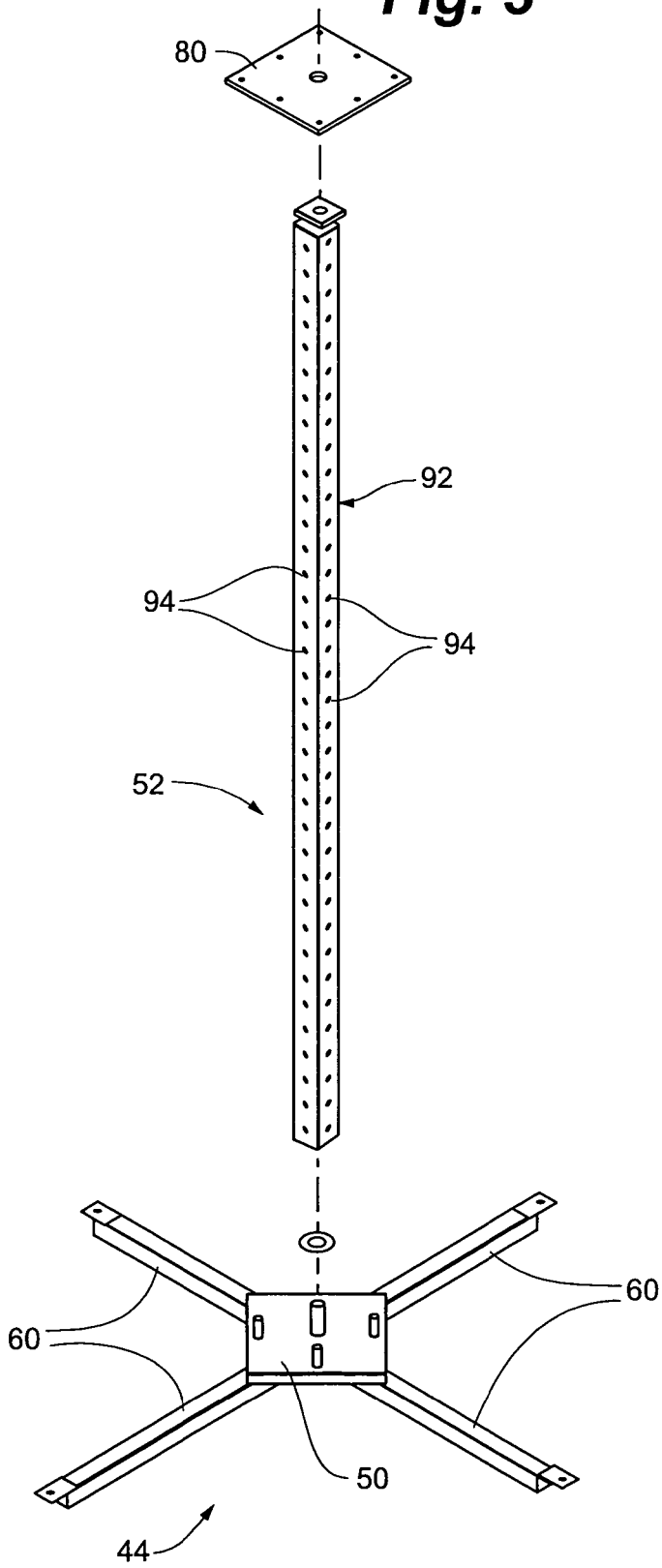
FIG. 3 is an exploded perspective view of a center column assembly of the corner storage cabinet.

Referring to FIGS. 1, 2 and 3, the support assembly 44 includes a bottom frame assembly 40 with a bottom frame 42 adjacent to the inside perimeter of housing structure 12, specifically, the interior bottom edges of the back panels 20 and the side panels 24. Using this configuration provides support for the housing structure 12 and prevents undue rolling or swaying of the bottom frame assembly 40 due to the placement of the contents on the support assembly 14. The bottom frame 42 is preferably constructed of tubular steel.

The bottom frame assembly 40 directly supports center column assembly 52 and has a plurality of support legs 60.

The support legs 60 are preferably metallic in construction, such as being fabricated of steel tubing. At the junction of individual support legs 60 is a bottom plate assembly 50. The bottom plate assembly 50 is fixed to the support legs 60 and provides the supporting structure for the center column assembly 52.

Figure 4:
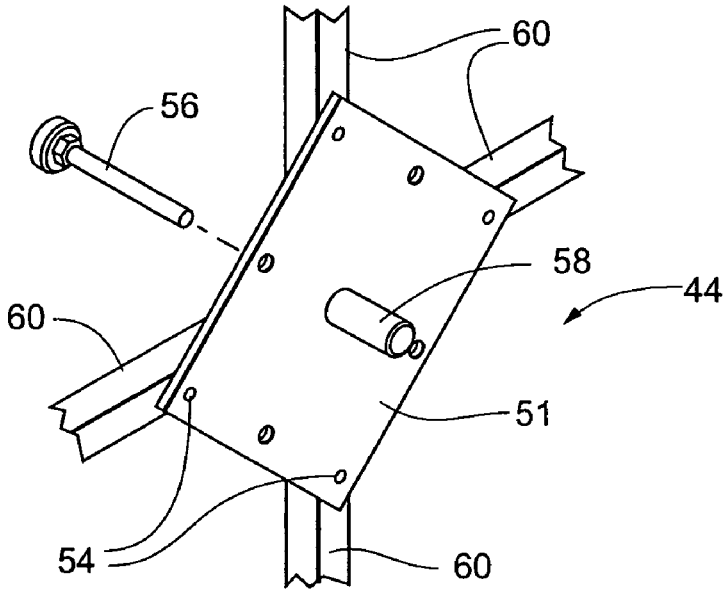
FIG. 4 is a perspective view of a base frame assembly of the center column assembly.

Referring to FIGS. 3 and 4, the bottom plate assembly 50 consists of a single center plate 51, preferably of steel construction, with a plurality of holes 54. The holes 54 are used for both securing the center plate 51 to the individual support legs 60 and attaching a plurality of leveler glides 56 (only one of which is shown). The leveler glides 56 allow for the leveling of the bottom frame assembly 40 to assure stability of the supported contents. At the midpoint of the center plate 51 is a base frame assembly post 58. The base frame assembly post 58 permits rotation of the center column assembly 52 about its longitudinal axis.

Referring to FIG. 2, a distal end 70 of each support leg 60 is attached a frame tab 72. The frame tab 72 is attached to the support leg 60 and a portion of the frame tab 72 longitudinally overhangs the distal end 70 of the support leg 60 and contains a clearance hole (not shown). The support leg 60 is fastened to the bottom frame 42 with a standard fastener, such as a capscrew, through both the clearance hole and a mating fastening hole (not shown) in the bottom frame 42.

Referring back to FIG. 3, upon the bottom frame assembly 40 is the center column assembly 52. The center column assembly 52 includes a center column 92, consisting of a multi-sided tube spanning a vertical height of the corner storage cabinet 10. The center column 92 is preferably constructed of a metallic material, such as steel tubing.

A bottom end plate (not shown) is attached to a lower end of the center column 92. The bottom end plate allows for rotation of center column 92 about the base frame assembly post 58. Bored out along the length of each side of the center column 92 are a plurality of positioning holes 94, in which supporting structures, described below, may be mounted. The plurality of positioning holes 94 allows for the placement of those supporting structures anywhere along the length of the center column 94.

At the top of the center column 92 is a top plate assembly 80. Referring to FIG. 2, the top plate assembly 80 includes a top plate 82. The top plate 82 has a plurality of mounting holes 84 for attachment to the top panel 22 and is preferably constructed of steel. The top plate 82 may be attached to the top panel 22 of the housing structure 12 using a standard fastener, such as a capscrew.

Figure 5:
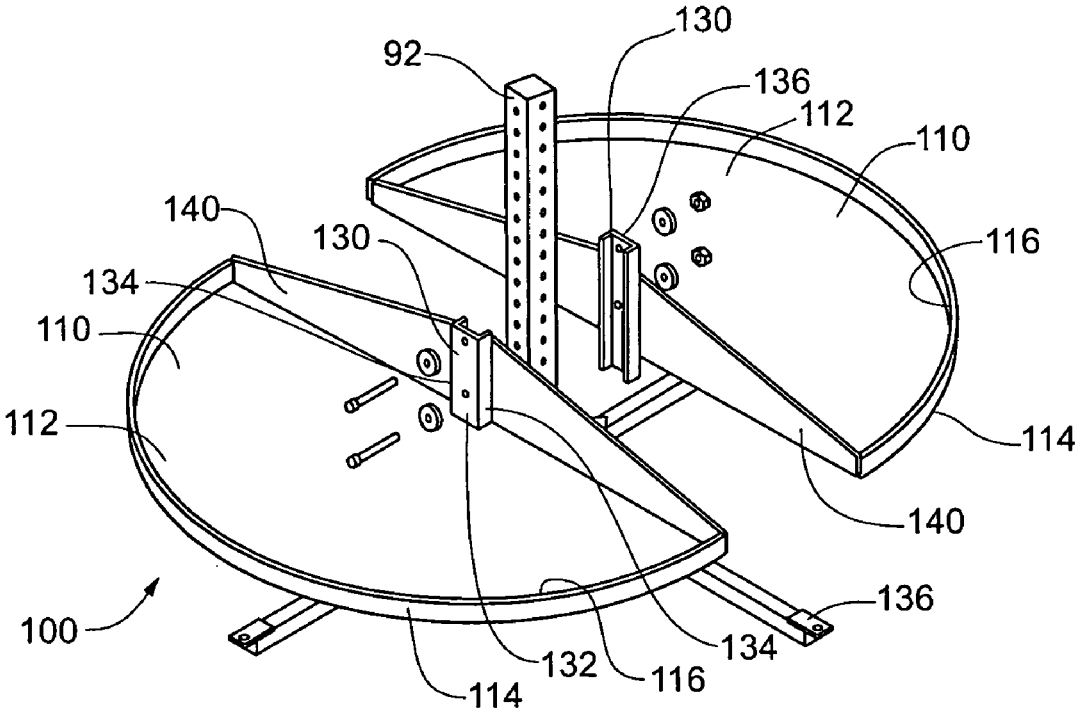
FIG. 5 is a perspective view of a partial shelf assembly of the corner storage cabinet.

Referring to FIG. 5, a preferred support structure of the support assembly 14 consists of shelving, specifically partial shelf assemblies 100. Each partial shelf assembly 100 includes a support surface 110. The support surface 110 is preferably made of metal. The support surface 110 provides a support face 112 upon which various objects may be placed. Along the outer perimeter of the partial shelf assembly 100 is an edge 114, which presents inner margin 116, providing a contact surface to prevent the sliding of the shelf contents from the shelf.

The partial shelf assembly 100 is preferably fastened to the center column 92 with a shelf support 130. The shelf support 130 has a mounting face 132 and two side faces 134. The shelf support 130 contains a plurality of mounting holes 136 on the mounting face 132 for securing the partial shelf assembly 100 to the center column 92.

The side faces 134 provide lateral resistance to rotation of the partial shelf assembly 100 about the center column 92. To provide structural support to the partial shelf assembly 100 and further retain the contents placed upon the shelf, an inner wall 140 is presented on both sides of the shelf support 130. The inner wall 140 extends radially from the upper edge of the mounting face 132 at a downward angle to meet the ends of the inner margin 116.

Figure 6:
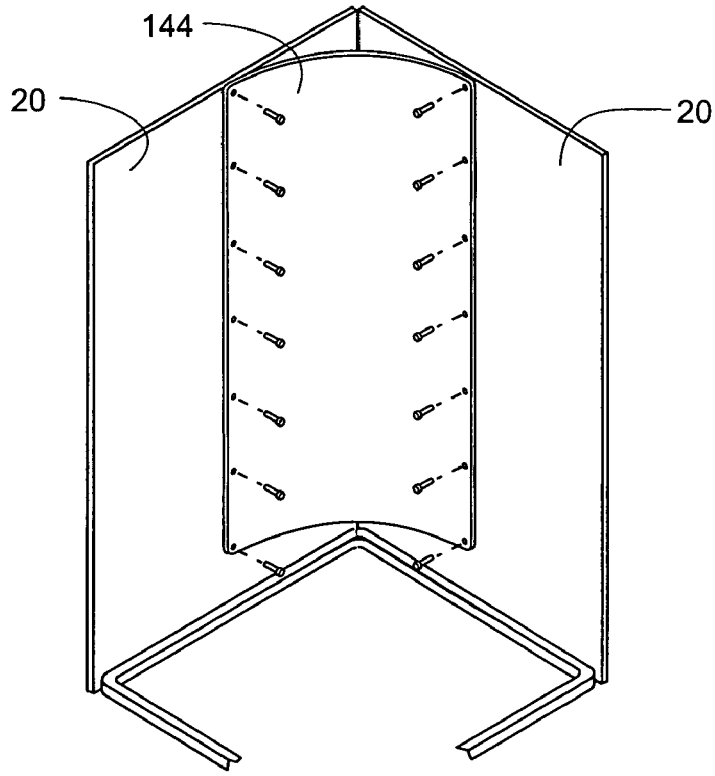
FIG. 6 is a perspective view of a deflector plate of the corner storage cabinet.

Referring to FIG. 6, a deflector plate 144 is provided to further protect and retain the contents of the partial shelf assembly 100 within the housing structure 12. The deflector plate 144 is an arcuate plate attached along the vertical length of both back panels 20 of the housing structure 12.

It should be noted that multiple partial shelf assemblies 100 may be mounted on adjacent faces at the same level of the central column 92 to form a larger coplanar shelf assembly for increased storage capacity.

Figure 7:
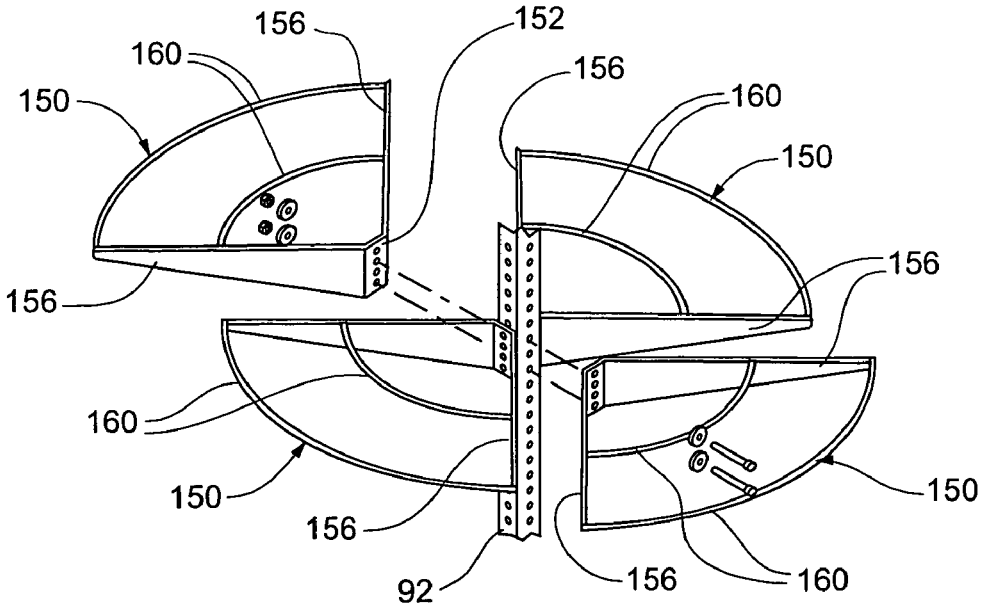
FIG. 7 is perspective view of a partial robe assembly for an alternative embodiment of the corner storage cabinet.
Figure 8:
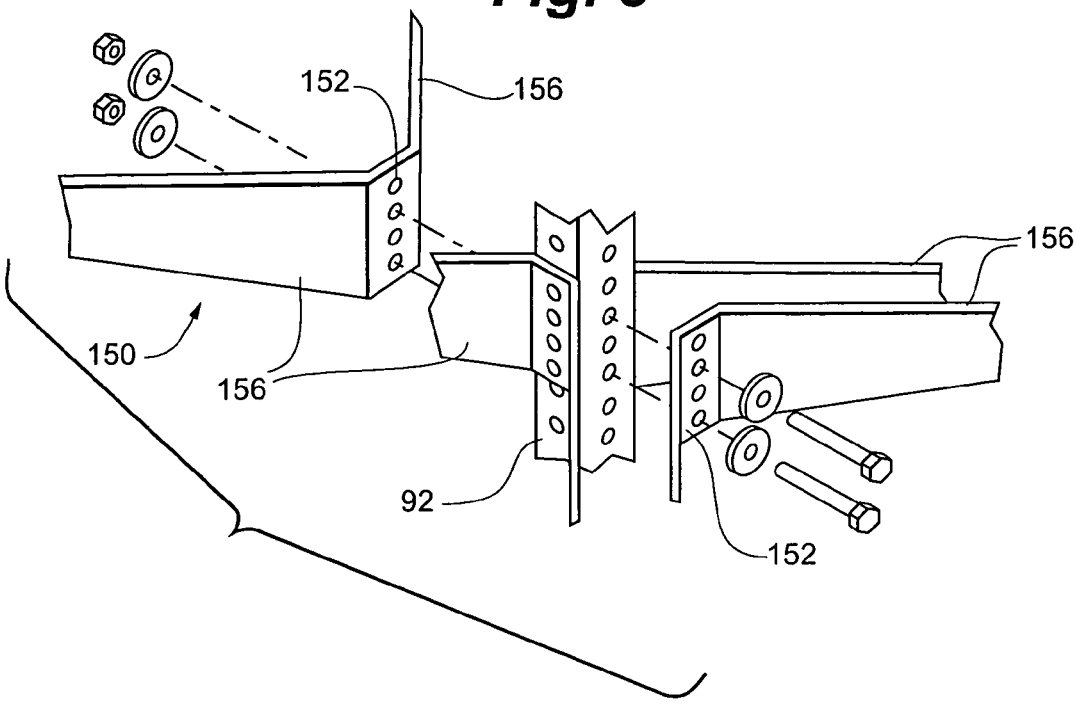
FIG. 8 is close-up view of a partial robe assembly mounting face of the partial robe assembly.

In an alternative arrangement, a flag/coral robe rack may be assembled and attached to the center column 92 for the storage of larger, upright items. Referring to FIGS. 7 and 8, a partial robe assembly 150 is situated in a similar manner to the partial shelf assembly 100. Each partial robe assembly 150 has a mounting face 152 for attachment to the center column 92. The mounting face 152 has a plurality of attachment holes for attachment therewith.

Projecting radially outward from the mounting face 152 are at least two side walls 156. The side walls 156 provide support for a plurality of containment rims 160. The containment rims 160 provide a support structure for various items that are to be stored in an upright position, such as flags or guns. The number of containment rims 160 will depend on the objects to be contained.

Figure 9:
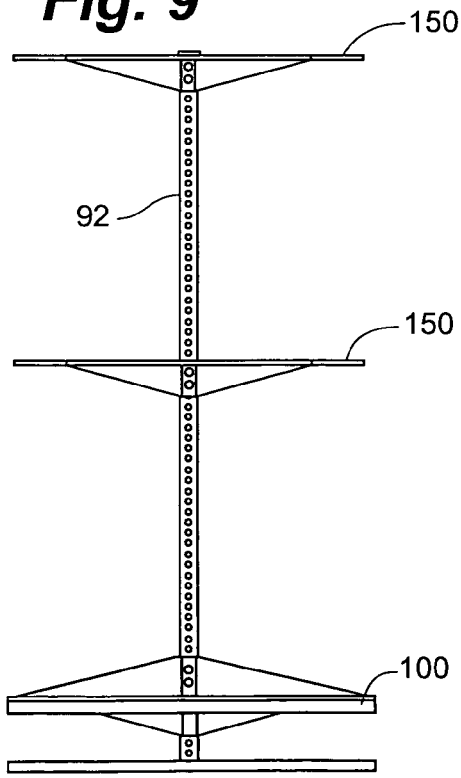
FIG. 9 is an elevational view of multiple partial robe assemblies for an alternative embodiment of the corner storage cabinet.

It should be noted that multiple partial robe assemblies 150 may be mounted on adjacent faces of the central column 92 to form a larger coplanar shelf assembly for increased storage. Referring to FIG. 9, multiple coplanar partial robe assemblies 150 may also be secured at varying heights along the center column 92 to provide enhanced support for various stored items.

Figure 10:
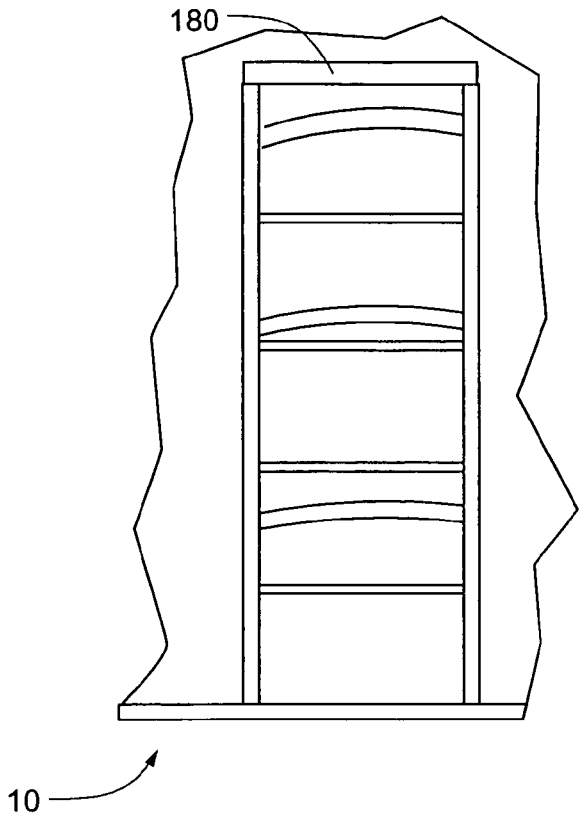
FIG. 10 is a perspective view of a cushioning pad used with the partial shelf assembly.
Figure 11:
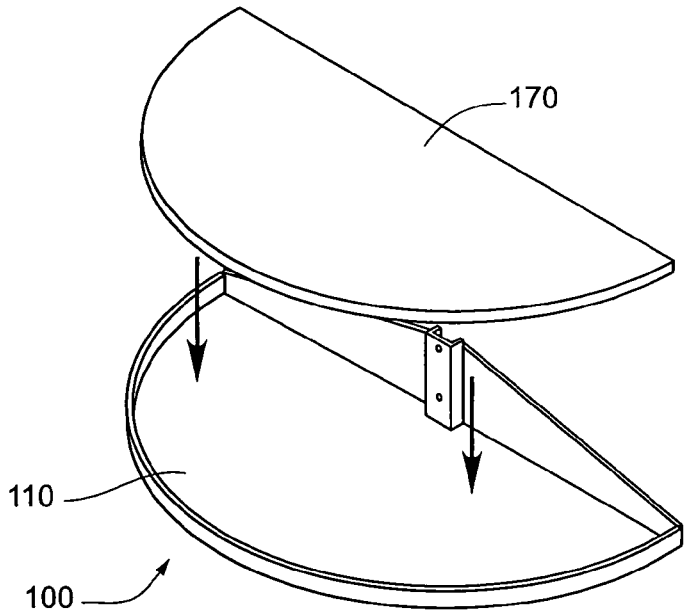
FIG. 11 is a perspective view of a front door for the corner storage cabinet.

Referring to FIG. 10, in the flag/coral robe rack configuration, a cushioning pad 170 may be applied to support surface 110 to reduce wear and tear on both the load bearing surfaces of the stored items and the support surface 110 of a partial shelf assembly 100. The cushioning pad 170 will also restrict the movement of the stored items on the partial shelf assembly 100.

As noted above, depending on the location where the corner storage cabinet 10 is to be used, the corner storage cabinet 10 may include a door 180 that covers the front opening 30 and thereby restricts access to items stored in the corner storage cabinet 10. The door 180 is pivotally attached to one of the side panels 24. A lock (not shown) is preferably provided on the door 180 to prevent unauthorized persons from opening the door 180.

The door 180 is preferably curved to substantially conform to a shape of the partial shelf assemblies 100. Alternatively, the door 180 may have a substantially flat shape. The door 180 is preferably fabricated from a plurality of bars. Fabricating the door 180 with this configuration also promotes ventilation to facilitate moisture dissipation from within the corner storage cabinet 10. A person of ordinary skill in the art will appreciate that the door 180 may also be fabricated from plastic, metal, or composite materials.

Because of the relatively large size of the corner storage cabinet, it is possible for a person to walk at least partially inside the corner storage cabinet to access items stored in the corner storage cabinet.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A corner storage cabinet for storing objects comprising:

a housing structure;

a center column assembly having a center column including structure defining a plurality of longitudinally spaced apart coupling sections, wherein the center column assembly is mounted in the housing structure; and a reconfigurable shelf assembly having at least two partial shelves, whereby the at least two partial shelves may be mounted to the center column to form a coplanar shelf surface, each said partial shelf comprising an attachment portion, at least two flanges extending outwardly away from the attachment portion and a supporting member extending between the two flanges, and a coupling element selectively, fixedly, removably coupling said attachment portion to said center column at a selected one of said longitudinally spaced apart coupling sections.

2. The corner storage cabinet of claim 1, wherein the housing structure has at least two back panels, a top panel, and at least two side panels, wherein a front opening is defined by a front edge of the top panel and a proximal edge of each of the at least two side panels.

3. The corner storage cabinet of claim 2, and further comprising a door for covering the front opening.

4. The corner storage cabinet of claim 1 and further comprising a base frame assembly and leveling means.

5. The corner storage cabinet of claim 1, wherein the reconfigurable shelf assembly is rotatable about a longitudinal axis of the center column.

6. A corner storage cabinet for storing objects comprising:

a housing structure;

a center column assembly having a center column including structure defining a plurality of longitudinally spaced apart coupling sections, wherein the center column assembly is mounted in the housing structure; and a reconfigurable shelf assembly having at least one partial shelf, wherein the at least one partial shelf has a mounting point and at least two edges extending radially from the mounting point, wherein an angle at which the edges intersect the mounting point is less than or equal to 180 degrees, said partial shelf comprising an attachment portion, at least two flanges extending outwardly away from the attachment portion and a supporting member extending between the two flanges, and a coupling element selectively, fixedly, removably coupling said attachment portion to said center column at a selected one of said longitudinally spaced apart coupling sections.

7. The corner storage cabinet of claim 6, wherein the housing structure has at least two back panels, a top panel, and at least two side panels, wherein a front opening is defined by a front edge of the top panel and a proximal edge of each of the at least two side panels.

8. The corner storage cabinet of claim 7, and further comprising a door for covering the front opening, wherein the door is convex with respect to the proximal edge of the at least two side panels.

9. The corner storage cabinet of claim 6, and further comprising a base frame assembly and leveling means.

10. The corner storage cabinet of claim 6, wherein the reconfigurable shelf assembly is rotatable about a longitudinal axis of the center column.

11. A corner storage cabinet for storing objects comprising:

a housing structure;

a center column assembly having a center column including structure defining a plurality of longitudinally spaced apart coupling sections, wherein the center column assembly is mounted in the housing structure; and a reconfigurable robe storage assembly having at least two partial containment rims, wherein the at least two partial containment rims may be mounted to the center column to form a continuous coplanar rim, each said partial containment rim comprising an attachment portion, at least two flanges extending outwardly away from the attachment portion and a supporting member extending between the two flanges, and a coupling element selectively, fixedly, removably coupling said attachment portion to said center column at a selected one of said longitudinally spaced apart coupling sections.

12. The corner storage cabinet of claim 11, wherein the housing structure has at least two back panels, a top panel, and at least two side panels, wherein a front opening is defined by a front edge of the top panel and a proximal edge of each of the at least two side panels.

13. The corner storage cabinet of claim 12, including a door for covering the front opening, wherein the door is convex with respect to the proximal edge of the at least two side panels.

14. The corner storage cabinet of claim 11, and further comprising a base frame assembly and leveling means.

15. The corner storage cabinet of claim 11, wherein the reconfigurable robe assembly is rotatable about a longitudinal axis of the center column.

16. A corner storage cabinet for storing objects comprising:

a housing structure;

a center column assembly having a center column including structure defining a plurality of longitudinally spaced apart coupling sections, wherein the center column assembly is mounted in the housing structure; and a reconfigurable robe assembly having at least one partial containment rim, whereby the at least one partial containment rim has a mounting point and at least two edges extending radially from the mounting point, the angle at which the edges intersect the mounting point being less than or equal to 90 degrees, said partial containment rim comprising an attachment portion, at least two flanges extending outwardly away from the attachment portion and a supporting member extending between the two flanges, and a coupling element selectively, fixedly, removably coupling said attachment portion to said center column at a selected one of said longitudinally spaced apart coupling sections.

17. The corner storage cabinet of claim 16, wherein the housing structure has at least two back panels, a top panel, and at least two side panels, wherein a front opening is defined by a front edge of the top panel and a proximal edge of each of the at least two side panels.

18. The corner storage cabinet of claim 17, and further comprising a door for covering the front opening.

19. The corner storage cabinet of claim 16, and further comprising a base frame assembly and leveling means.

20. The corner storage cabinet of claim 16, wherein the reconfigurable robe assembly is rotatable about a longitudinal axis of the center column.

21. A method of making a corner storage cabinet for storing objects comprising:

providing a housing structure;

mounting within the housing structure a center column assembly having a center column including structure defining a plurality of longitudinally spaced apart coupling sections; and attaching a reconfigurable shelf assembly having at least one partial shelf, whereby the at least one partial shelf has a mounting point and at least two edges extending radially from the mounting point, the angle at which the edges intersect the mounting point being less than or equal to 180 degrees, said partial shelf comprising an attachment portion, at least two flanges extending outwardly away from the attachment portion and a supporting member extending between the two flanges, and a coupling element selectively, fixedly, removably coupling said attachment portion to said center column at a selected one of said longitudinally spaced apart coupling sections.

22. The method of claim 21, including leveling any supported contents of the reconfigurable shelf assembly.

23. The method of claim 21, including attaching a deflector plate to the housing structure.

* * * * *